US005163366A

United States Patent [19]

Gregoire et al.

[11] Patent Number: 5,163,366

[45] Date of Patent: Nov. 17, 1992

[54] PRINT WHEEL ADJUSTMENT DEVICE FOR FRANKING MACHINES

[75] Inventors: Jean-Pierre Gregoire, Bagneux; Jean-Claude Haroutel, Orsay, both of France

[73] Assignee: Alcatel Satmam, Bagneux, France

[21] Appl. No.: 740,674

[22] Filed: Aug. 6, 1991

[30] Foreign Application Priority Data

Aug. 7, 1990 [FR] France ..... 90 10064

[51] Int. Cl.[5] ..... B41L 47/46

[52] U.S. Cl. ..... 101/91; 101/45

[58] Field of Search ..... 101/45, 85, 86–89, 101/91, 92, 99, 110

[56] References Cited

U.S. PATENT DOCUMENTS

| | | | |
|---|---|---|---|
| 4,398,845 | 8/1983 | Denzin et al. | 101/91 |
| 4,520,725 | 6/1985 | Haug | 101/45 |
| 4,601,240 | 7/1986 | Sette | 101/91 |
| 4,603,627 | 8/1986 | Pollak, Jr. et al. | 101/91 |
| 4,702,164 | 10/1987 | Muller | 101/91 |
| 4,723,348 | 2/1988 | Le Meur et al. | 101/91 |
| 4,774,881 | 10/1988 | Schubert | 101/91 |
| 4,858,525 | 8/1989 | Hubbard et al. | 101/91 |
| 5,050,495 | 9/1991 | Wu | 101/91 |

FOREIGN PATENT DOCUMENTS 2102346 2/1983 United Kingdom .

*Primary Examiner*—Edgar S. Burr
*Assistant Examiner*—Ren Yan
*Attorney, Agent, or Firm*—Sughrue, Mion, Zinn, Macpeak & Seas

[57] ABSTRACT

Device for adjusting print wheels of a franking machine print head where said print head is removable from a base unit and comprises a print drum incorporating said print wheels and carried at a forward end of a sleeve having its rear end projecting from the rear of the print head. The base unit has a location at the front for the print head and comprises a drive mechanism, control circuits connected to the drive mechanism and a rotating shaft coupled to the drive mechanism and partially projecting into the location for the print head to receive the sleeve on it and to drive the print drum. The device comprises a drive system comprising at least one drive motor and at least one driving gear coupled to the control circuit. Driven gears are each coupled to a different print wheel mounted with it in the print head. Sliding rods with front and rear racks thereon are mounted in the print head with the front rack of each rod meshing with one of the driven gears to impart thereto movement from the drive system. The drive system is mounted in the base unit in an interface housing behind the housing for the print head and at the periphery of the shaft and the sleeve fitted over the shaft. The rear racks of the sliding rods project at least partly from the rear of the print head and are inserted with the rear end of the sleeve into the base unit. The drive system is thereby adapted to be engaged with the rear racks of the sliding rods and constitutes in the base unit a control interface for adjusting the print wheels of the print head.

13 Claims, 5 Drawing Sheets

PRINT WHEEL ADJUSTMENT DEVICE FOR FRANKING MACHINES

BACKGROUND OF THE INVENTION

1. Field of the Invention

The present invention concerns franking machines with a print head removably mounted on a base unit in which the print head is a print drum carrying print wheels. It is more particularly concerned with the print wheel adjustment device in such machines.

2. Description of the Prior Art

Known print wheels are rotatably mounted on the print drum to enable their position to be adjusted when no franking operation is in progress. They project slightly from the periphery of the drum and rotate with it to print fixed and variable franking information on each rotation of the drum. The wheels print variable information: franking amount and date. The print drum therefore comprises two sets of wheel for this variable information, projecting from the drum through appropriate openings in a printing plate carrying the franking imprint. This printing plate is mated to the periphery of the drum and carries the fixed franking information in the form of the franking imprint or the imprint of the local post office or of any other kind. The same drum usually carries another printing plate for promotional devices, similar to the first but often retractable. In some machines other printing means such as one or more retractable stamps are associated with the drum.

U.S. Pat. No. 4 090 063 describes a franking machine of this type with a manually controlled device for adjusting each value print wheel. This device comprises, between each print wheel and its control system, identical transmission means with driving gears coupled to each other and to the manual control device and one or more driven gears coupled to each other and to the print wheel concerned, with two racks coupled to each other and to one of the driving and driven gears.

Other franking machines use automatic control of adjustment of the position of each print wheel rather than manual control. This automatic control is exercised from the keypad of the machine via logic circuits connected to a motor driving one of the driving gears as described above.

In removable print head franking machines the print wheel position adjustment control device and the associated motors are mounted in the print head. This makes the print head relatively bulky and heavy, with the result that it is more difficult to transport. Also, the removable print head is a secure unit to which access by the user and any other person not authorized by the postal authorities is prohibited. The authorized staff member may therefore need to be called in to deal with any maintenance problem concerning the print wheel adjustment device, which includes any complex parts.

One object of the present invention is to avoid such drawbacks.

SUMMARY OF THE INVENTION

The present invention consists in a device for adjusting print wheels of a franking machine print head where said print head is removable from a base unit and comprises a print drum incorporating said print wheels and carried at a forward end of a sleeve having its rear end projecting from the rear of the print head, said base unit having a location at the front for said print head and comprising a drive mechanism, control circuits connected to said drive mechanism and a rotating shaft coupled to said drive mechanism and partially projecting into said location for said print head to receive said sleeve on it and to drive said print drum, the device comprising:

a drive system comprising at least one drive motor and at least one driving gear coupled to said control circuit, a plurality of driven gears each coupled to a respective print wheel with which it is mounted in said print head, and a plurality of sliding rods with front and rear racks thereon mounted in said print head with the front rack of each rod meshing with one of said driven gears to impart thereto movement from said drive system, in which device:

said drive system is mounted in said base unit in an housing behind said housing for said print head and at the periphery of said shaft and said sleeve fitted over said shaft, said rear racks of said sliding rods project at least partly from the rear of said print head and are inserted with said rear end of said sleeve into said base unit, and said drive system is thereby adapted to be engaged with said rear racks of said sliding rods and constitutes in said base unit a control interface for adjusting said print wheels of said print head.

Said control interface is preferably carried by a hub adapted to rotate in said interface housing about said sleeve on said shaft and driven by an interface angular orientation motor mounted in said base unit and coupled to said control circuit.

Said hub preferably incorporates a vertical toothed ring parallel to the front and rear walls of said base unit, the teeth of which mesh with a gear driven by said angular orientation motor.

Said control interface preferably comprises the same number of individual motors as print wheels assigned to a common function in the print head, respectively franking wheels and date wheels, with a cascade of three driving gears associated with each individual motor.

Six individual motors for six franking or date wheels and their six cascades of driving gears are preferably carried by six support members in a fan arrangement having a plane of symmetry.

The device preferably further comprises supplementary print wheels carried by the print drum and assigned to the automatic control of supplementary printing devices carried by or associated with the drum, for which there are supplementary driven gears and supplementary sliding rods identical to and alongside the sliding rods for the franking and date print wheels for adjusting the supplementary print wheels from the interface circuit and thereby adjusting the supplementary printing devices.

The features and the advantages of the present invention will emerge from the following description of a preferred embodiment of the invention shown in the accompanying drawings.

DETAILED DESCRIPTION OF THE INVENTION

The franking machine is the subject of French patent application No 90 08 752 filed Jul. 10, 1990. This machine is described in the present application with reference to FIG. 1 and/or FIG. 2 only in respect of the mounting of the print head on the base unit.

The machine has a removable print head 1 mounted on a base unit 2.

Figure 1:
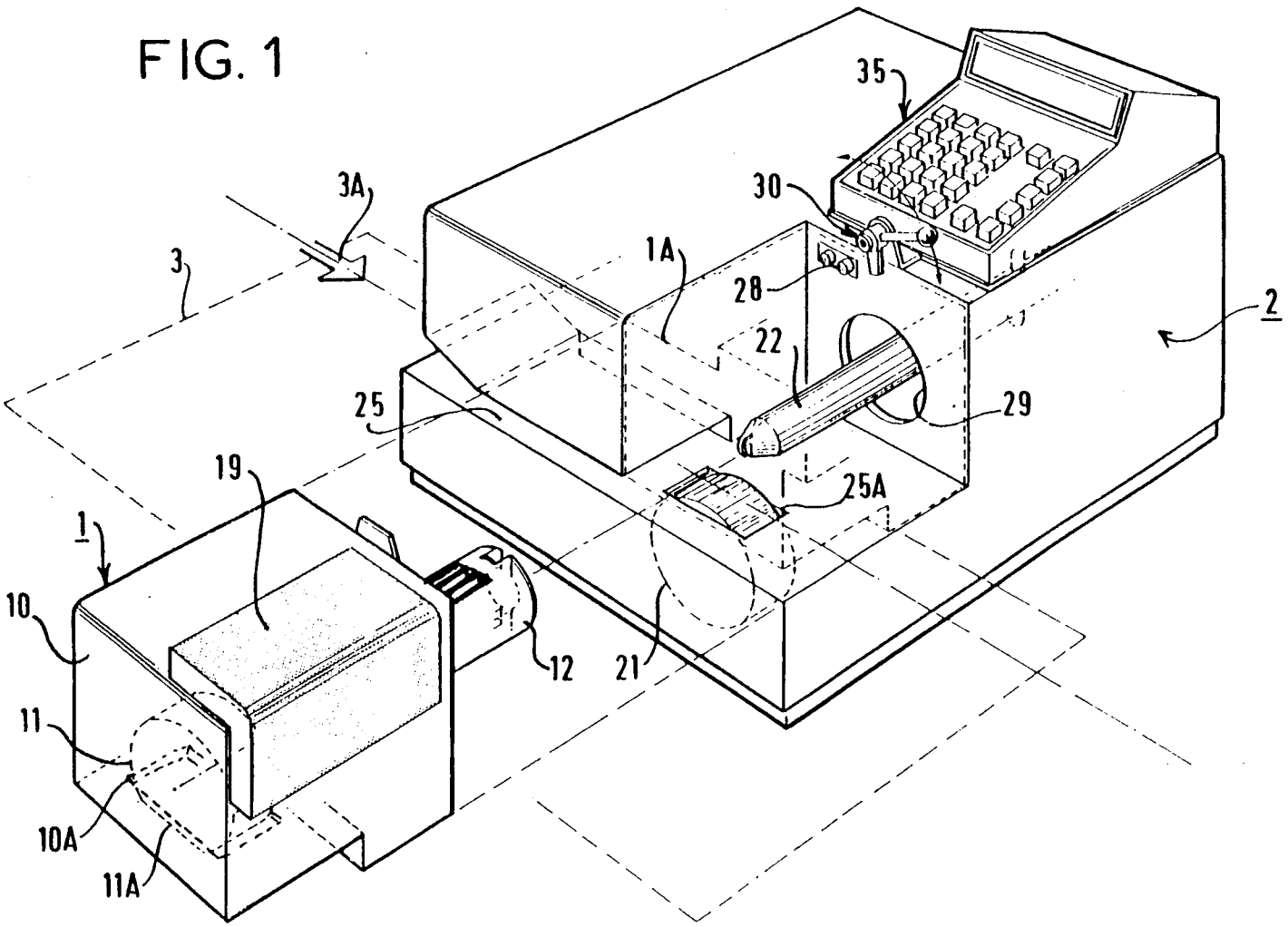
FIG. 1 is a diagrammatic perspective view of the removable print head type franking machine to which the device in accordance with the present invention is fitted.

In FIG. 1, the position of the print head on the base unit is shown in dashed outline at 1A. The arrow 1B shows how it is fitted and the arrow 3A shows the movement of a mail item 3 under the print head when fitted.

The print head 1 is a secure unit, the various component parts of which are mounted within a virtually closed module 10 which the user is not authorized to access. It essentially comprises a print drum 11, a sleeve 12 and a circuit board 13 carrying the accounting circuits of the machine.

The drum 11 has a flat 11A which is flush with the bottom of the module through an aperture 10A when the drum is in an idle position. It carries on its periphery a printing plate 14 for printing the franking or local office imprint and two sets of print wheels (15, etc) for printing the franking amount and the date. The drum also carries means (not shown) for printing promotional devices, similar to the printing plate 14 but retractable.

The print wheels 15 project slightly through the plate 14 at the periphery of the drum and rotate with it. They are adjusted to the required amount and date by the device in accordance with the present invention.

The sleeve 12 carries the drum on its front end part inside the print head. Its rear end part projects from the rear of the print head to provide access to the bore in it. It is used to mount and secure the print head on the base unit and to rotate the drum from the base unit. It is rotatably mounted in the print head between two ball bearings 16 and 17 on the inside of the front wall and in an aperture in the rear wall.

The accounting circuit board 13 is fixed to one of the side walls or to the top wall of the print head. It is connected to a connector 18 mounted in the rear wall of the print head to connect it to the base unit.

A rough, thicker section of the exterior of the module facilitates holding the print head in one hand to mount it on the base unit or to demount it therefrom.

The base unit 2 is a separate assembly to which access is unrestricted. For a person standing in front of the base unit, the front righthand corner is cut away to define the location 1A of the print head. Of course, the base unit can form part or be connected to a mail handling installation.

The base unit includes a slot 20 through which mail items can be passed under the print head. It incorporates a printing pressure roller 21, a shaft 22, a mechanism for driving the shaft and the pressure roller (not shown), and at least one base unit and print head control circuit board 24.

The slot 20 is horizontal and opens into the recess or location 1A of the print head on the base unit. Its lower side forms a continuous platform 25 across which the mail items pass through the base unit and under the print head when fitted.

The shaft 22 is horizontal and or mounted in the base unit. It is supported by a ball bearing on the rear wall (not shown) and a ball bearing 27 on an intermediate crossmember 26. Its front end part is accessible at the front of the base unit and preferably projects into the location 1A for the print head on the base, through a large aperture 29 in a front wall 2A. It is inserted into the sleeve; when the print head is fitted, the rear part of the sleeve is inserted into the base unit through the opening 29.

When the print head is fitted, means 22A and/or 22B on the shaft 22 and complementary means 12A and/or 12B on the sleeve 12 lock the sleeve onto the shaft to rotate with it. A connector 28 on the base unit and the connector 18 on the print head provide the electrical connection between the print head and the base unit.

A mechanism 30 comprising complementary means on the base unit and on the print head locks the print head in position on the base unit.

The printing pressure roller is mounted at the end of a shaft (not visible) under the housing 1A for the print head. It projects into the platform 25, through an aperture 25A, facing the print drum 11 of the print head when fitted. The shaft of the pressure roller is parallel to the shaft 22, i.e. horizontal, and is rotatably mounted in roller bearings in the base unit.

The drive mechanism for the pressure roller 21 and the print drum 11 is entirely housed within the base unit. It is coupled to the pressure roller shaft and to the shaft 22 to drive them in the direction of the arrow 32 in the case of the shaft 22 and in the opposite direction in the case of the pressure roller, under the control of signals generated by the control circuit board 24.

The base unit 2 further comprises a data entry and display unit 35 in the form of a keypad and associated display screen. These are mounted on the upper surface of the base unit and connected to the control circuit board 24.

Figure 2:
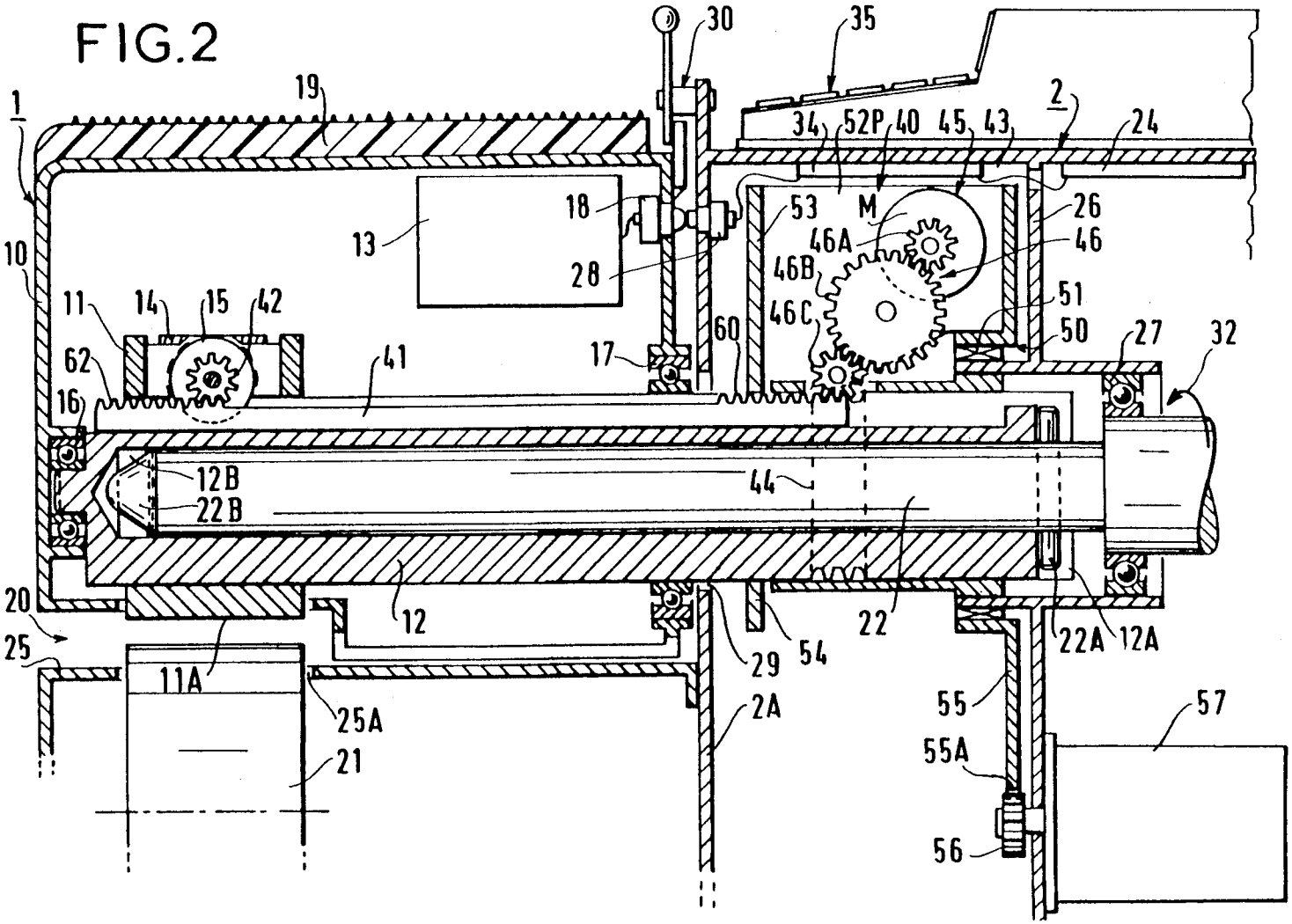
FIG. 2 is a schematic view of the machine from FIG. 1 in partial cross-section showing the machine fitted with the print wheel adjustment device in accordance with the invention.

The print wheel adjustment device in accordance with the present invention is described in general terms with reference to FIG. 2.

It comprises a control system 40 and, for the various print wheels, respective sliding rods 41 carrying toothed racks and driven gears 42.

The control system 40 is mounted within the base unit 2, but the sliding rods 41 and the driven gears 42 are part of the print head. The control system is accommodated within an annular housing 43 around the sleeve on the shaft, between the crossmember 26 in the base unit and the front wall 2A through which the sleeve 12 enters the base unit. Within the base unit 2 it constitutes a control interface for adjustment of the print wheels of the print head 1, and is so designated hereinafter. Within the base unit, it receives adjustment control signals from the control circuit board 24 via an interconnect circuit board 34. The interconnect circuit board 34 is mounted on one of the walls delimiting the housing 43 for the control interface and is connected by slack wiring links to the interface 40. It is also connected to the control circuit board 24 at the aforementioned connector 28.

The control interface 40 is described with reference to FIG. 2 and/or FIG. 3. It comprises a set 45 of motors M and a set 46 of driving gears in cascade, there being one cascade of driving gears for each motor. Each cascade is formed in this example of three driving gears, meshing with each other and driven by the respective motor: a gear 46A is driven by the motor and drives an intermediate gear 46B which drives the third gear 46C which drives one of the sliding rods.

The number of individual motors and cascades of driving gears 46 is advantageously less than the number of print wheels, in other words the number of driven gears or sliding rods in the head 1. It is preferably equal to the number of franking or date wheels, that is to say six for either of the two groups of wheels assigned to these two functions. The six motors and the six cascades of gears then control the same function wheels simultaneously.

Figure 3:
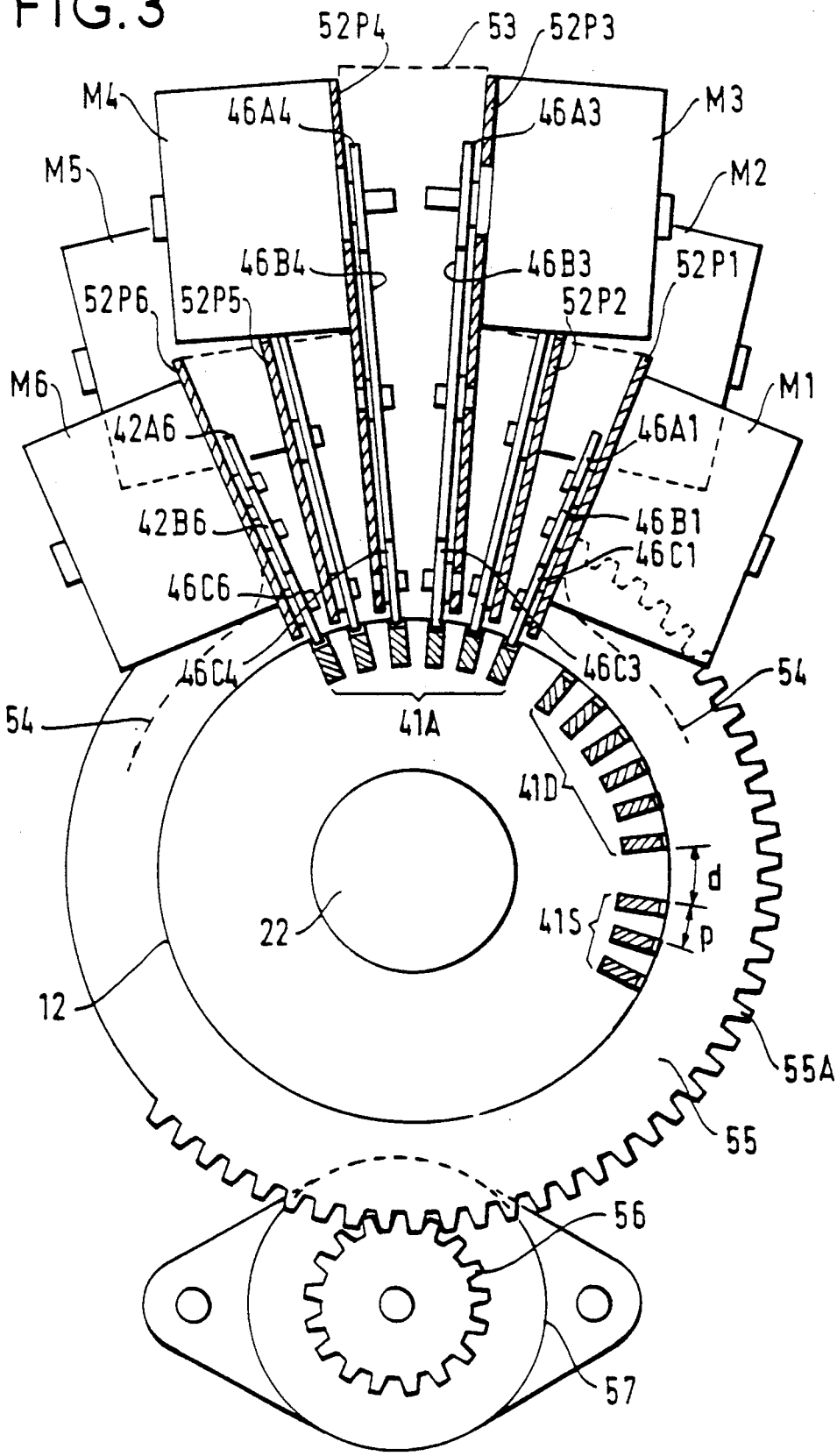
FIG. 3 is an enlarged schematic view of the control part of the device in accordance with the invention called the franking machine adjustment control interface.

In FIG. 3, in which the six individual motors and the six cascades of driving gears are all visible, the motors are designated M1 through M6, the gears that they drive 46A1 through 46A6, the intermediate gears 46B1 through 46B6 and the gears driving the sliding rods 46C1 through 46C6.

In an alternative embodiment (not shown), the control interface may comprise a single motor with a single cascade of associated driving gears, for adjusting the wheels one by one. In a further embodiment (not shown), the control interface has three motors with three cascades of associated driving gears, for adjusting the six franking or date wheels in two stages.

The control interface 40 is mounted to oscillate within its housing 43 around the sleeve on the shaft. Its angular position on the sleeve, when idle, is controlled by orientation control signals from the control circuit board 24. A semi-annular groove 44 on the rear part of the sleeve provides space for the driving gears 46C when activated. The profile of this groove matches three teeth of the driving gear 46C.

The control interface is mounted on a hub 50 centered on the sleeve on the shaft. The hub is carried by the crossmember 26 in a smooth bearing 51. Six support members or plates 52P1 through P6 fixed to the hub carry the six motors M and the six cascades of gears 46. They are fixed at the end opposite the hub 50 onto a flange 53 forming a projecting appendix on a centering ring 54.

A vertical shoulder of the hub 50 parallel to the front and rear walls of the base unit and substantially in contact with the crossmember 26 forms a toothed ring 55 with teeth 55A. These semi-peripheral teeth prevent complete rotation of the motors and cascaded gears. A gear 56 meshes with the teeth 55A. It is mounted on the shaft of an angular position control motor 57 connected to the control circuit board 24 and mounted behind the crossmember 26.

The driven gears 42 are mounted directly on the spindle of the respective wheel.

The sliding rods are identical to each other. They are described with reference to FIGS. 2 and 3.

Each comprises a rear rack 60 and a front rack 62 at their respective ends. They extend side by side along generatrices of the sleeve, substantially from the front end part of the sleeve in the print head to its projecting rear part, but not right to the end. The rods are housed in longitudinal grooves 63 on the sleeve, allowing access to the racks by the driving gears and the driven gears, the driven gears being all in direct mesh with the front rack 62 of the respective sliding rod. The method of securing the sliding rods in the grooves in such a way that they can slide is known in itself and is therefore neither shown nor described.

The sliding rods 41 define groups in corresponding relationship to the groups of wheels. These rods or their racks are designated in FIG. 3 by the letter A, D or S as a suffix to their reference number according to whether they relate to franking wheels (A), date wheels (D) or supplementary wheels (S) to be described later.

Within a group the sliding rods are at the same pitch p, but two consecutive rods belonging to different groups are preferably separated by a distance d greater than the pitch p.

Three supplementary driven gears identical to the other gears and three associated supplementary sliding rods identical to the other sliding rods are advantageously provided in the adjustment device for executing specific supplementary functions from the same control interface 40.

The function of the first gear/sliding rod is to deploy or to retract a promotional device printing plate carried by the print drum. The function of the other two is to deploy or retract two specific stamps associated with the print drum in certain existing franking machines. The three supplementary wheels are mounted on the print drum where they each act as an automatic actuator of the corresponding member to be retracted or deployed to its printing position or one of a plurality of possible printing positions.

These automatic actuator means are purely and simply substituted for the manual actuator means provided in some franking machines for such supplementary printing means. The principle of coupling each actuator to the actuated member by means of articulated linkages and levers being already known in itself, there is no need to show it or describe it here.

The disposition of the motors M and the cascaded gears of the rotary control interface 50 will now be described in more detail with reference to FIGS. 3 through 5.

This disposition is defined in relation to the fan-like disposition of the sliding rods 41 or their racks 62, to obtain a modular control interface 40 of minimal overall dimensions. The description assumes that the drive gears 46C are meshed with the six racks 62 of the same group.

The six support members 52P1 through P6 are plane and disposed in a fan configuration with a plane of symmetry P. Each is parallel to one of the racks 62. Each supports the relevant motor M and the spindles of the cascade of driving gears 46A through C for this motor M, the cascade of driving gears being coplanar with the rack concerned.

The cascades 46 of driving gears are therefore themselves disposed in fan-like planes, with a constant pitch between them. They are symmetrical in pairs to the plane P.

The disposition of the driving gears in their respective planes and of the cascades from one plane to another is such that the coupling between each motor M and the relevant rack 62 is as short as possible with minimum overall dimensions.

Figure 5:
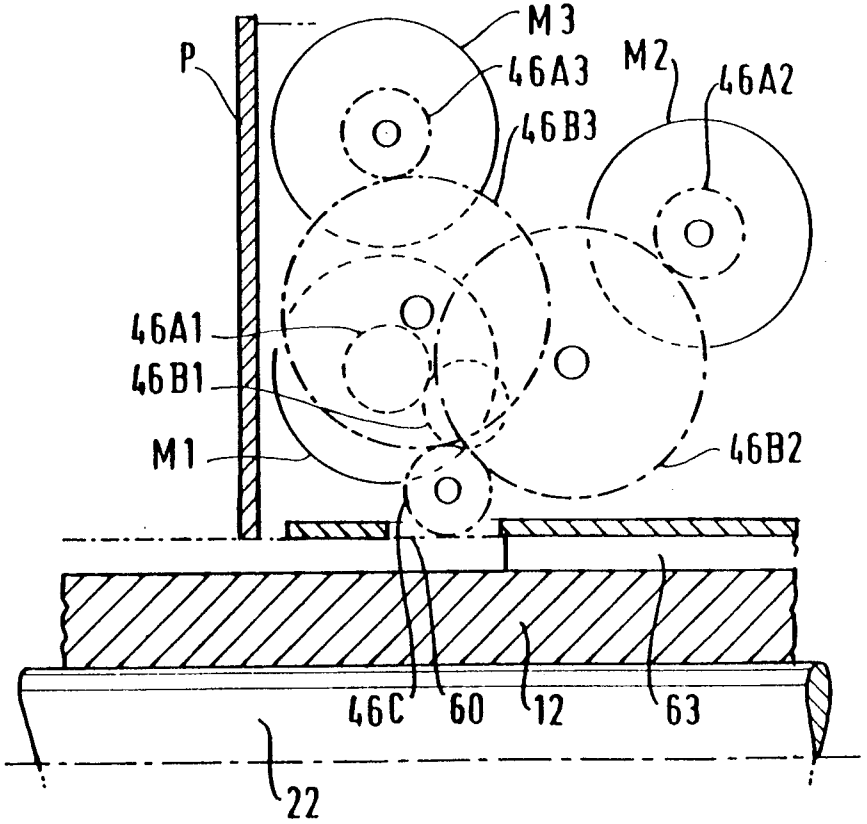
FIG. 5 is a view of the interface projected onto its plane of symmetry, which is shown in FIG. 4.
Figure 4:
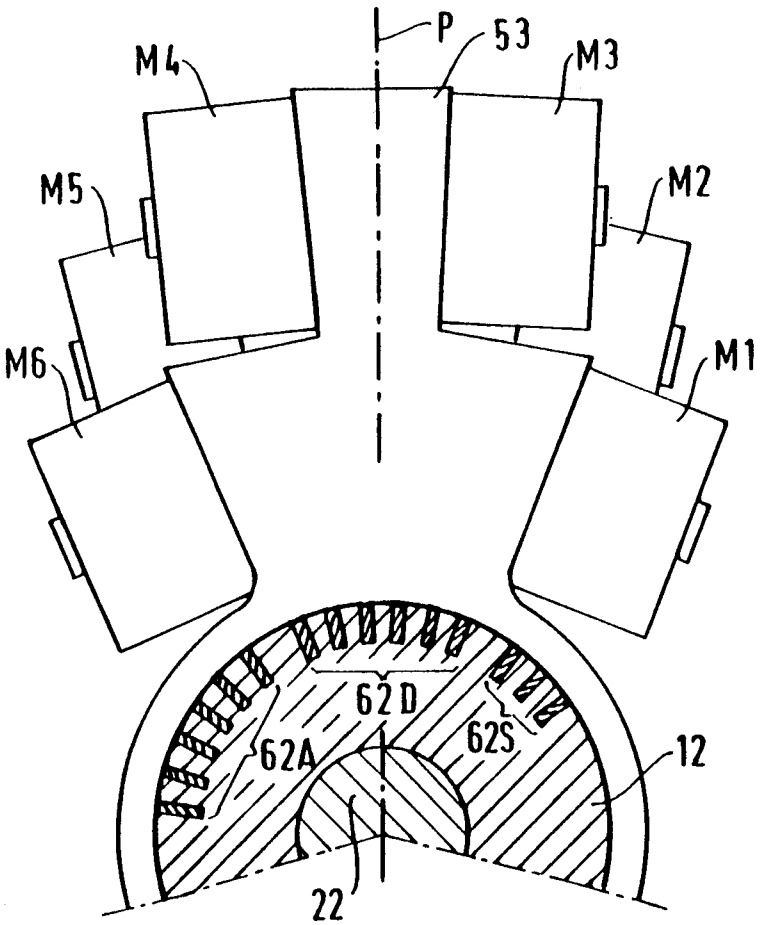
FIG. 4 is a schematic view of the control interface.

With particular reference to FIGS. 4 and 5, it can be seen that the symmetrical motors M1 and M3 and the symmetrical motors M4 and M6 are disposed in a common plane transverse to their individual support planes and that the motors M2 and M3 are in another plane transverse to their support plates. The drive gears 46C1 through C6 of the cascaded gears are relatively small and identical. They are in sequence at the same pitch as the racks and mesh with the respective racks 62 having the same function to control them. The motor gears 46A1 through A6 are also identical. The intermediate gears 46B1 through B6 are identical in pairs. Their diameters are adapted to coupling each motor gear to the relevant drive gear.

The motors M1 through M6 are stepper motors with a step size which is a sub-multiple of the rack pitch or DC motors.

Figure 6:
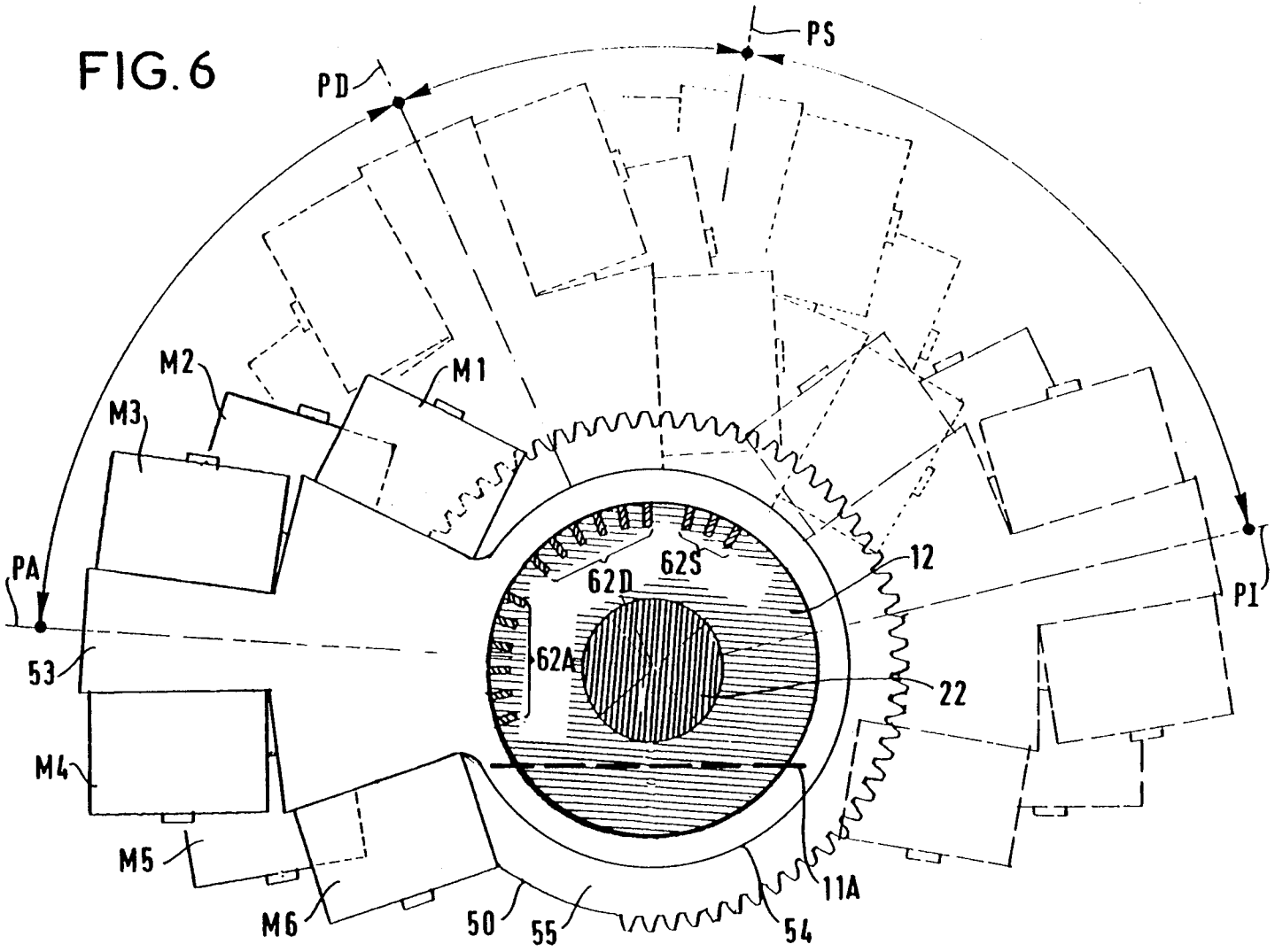
FIG. 6 is a schematic view showing how the control interface operates.

The operation of the adjustment device is shown in FIG. 6, which shows the three positions PA, PD and PS of the plane of symmetry of the control interface for the three adjustment orientations: franking wheels, date wheels and supplementary wheels, obtained by driving the toothed ring 55 of the hub 50 around the sleeve 12. The orientation PI for fitting the print head onto the base is also shown. In this orientation the control interface is aligned with the sector of the sleeve with no racks. The fitting of the print head onto the base unit in the position PI and the adjustment of the franking amount, date and supplementary print means in the positions PA, PD and PS are carried out with the sleeve 12 held in the idle position. This idle position is represented by the position of the flat 11A on the drum shown in thick dashed line.

The present invention has been described with reference to the preferred embodiment shown. It is obvious that detailed modifications may be made thereto without departing from the scope of the invention. In particular, the choice of six individual motors in the control interface circuit is not limiting on the invention.

There is claimed:

1. Device for adjusting print wheels of a franking machine comprising a base unit, a print head, said print head being removably mounted to said base unit and comprising a sleeve having a forward end and a rear end a print drum incorporating a plurality of first print wheels carried at the forward end of said sleeve, the rear end of said sleeve projecting from a rear of the print head, said base unit having a front and a rear, a recess located at the front of the base unit for receiving said print head and comprising a drive mechanism, control circuits connected to said drive mechanism and a rotatable shaft coupled to said drive mechanism and partially projecting into said recess for said print head and insertably receiving said sleeve to drive said print drum, the device comprising:

a drive system comprising at least one drive motor coupled to said control circuit and at least one driving gear, a plurality of driven gears each coupled to a respective one of said first print wheels and being mounted in said print head, and a plurality of sliding rods having front and rear racks thereon and being mounted in said print head with the front rack of each rod meshing with one of said driven gears to impart movement thereto from said drive system, and in which device:

said drive system is mounted in said base unit in an interface housing behind a housing for said print head and at the periphery of said shaft and said sleeve is slidably fitted over said shaft, said rear racks of said sliding rods projecting at least partly from the rear of said print head and being partially, with said rear end of said sleeve, in said base unit, and said drive system being engaged with said rear racks of said sliding rods and constituting in said base unit, a control interface means for adjusting said print wheels of aid print head.

2. Device according to claim 1 wherein said base comprises an interface housing, a hub mounted to said interface housing for rotation about said sleeve, said control interface means is carried by said hub for rotation in said interface housing about said sleeve on said shaft and an interface angular orientation motor mounted in said base unit, coupled to said control circuit and means for operatively coupled said interface angular orientation motor to said hub.

3. Device according to claim 2 wherein said hub comprises a vertical toothed ring extending parallel to front and rear walls of said base unit, said ring having teeth meshed with a gear driven by said angular orientation motor and constituted said means for operatively coupling said interface angular orientation motor to said hub.

4. Device according to claim 3 wherein said toothed ring has teeth extending over part of a ring periphery to effect oscillation of said control interface means facing said front racks and placement of said control interface means in an idle position thereby allowing mounting of said print head onto said base externally of said base and said rear racks occupy only part of the periphery of said sleeve.

5. Device according to claim 4 wherein said control interface means comprises a single control motor coupled to said toothed ring for adjusting said first print wheels in succession.

6. Device according to claim 4 wherein said control interface means comprises a plurality of motors, the number of said motors being equal to a submultiple of the number of first print wheels assigned to a same function such as franking or dating.

7. Device according to claim 4 wherein said control interface means comprises a same number of motors as first print wheels assigned to a same function such as franking or dating.

8. Device according to claim 7 wherein said control interface means comprises a respective cascade of driving gears coupling each of said motors to the rear rack of a respective sliding rod.

9. Device according to claim 8 further comprising six motors and respective cascades of driving gears disposed in a fan arrangement, six support members disposed on the periphery of said sleeve on said shaft fixed to said hub for carrying said six motors, six first print wheels and six sliding rods for the six first print wheels coupled to said interface means, said six support members being parallel to the six sliding rods and each defining a respective planar support for one of said six motors and the cascade of driving gears associated with said motor which is coplanar with the respective rear rack.

10. Device according to claim 9 wherein the six support members with the respective motors and the respective cascades of driving gears form identical pairs disposed to opposite sides of a vertical plane of symmetry.

11. Device according to claim 10 wherein said cascades of driving gears each comprise a motor gear, an intermediate gear and a drive gear for driving the rear rack of the respective sliding rod, said drive gears being identical from one cascade to another and having a same pitch as the of the rear racks of the sliding rods for the first print wheels, and the motor gears being identical to each other and the intermediate gears coupling the motor gears to the drive gears.

12. Device according to claim 2 further comprising supplementary print wheels carried by said print drum and automatic control means of supplementary printing devices carried by or associated with said drum, supplementary driven gears and supplementary sliding rods identical to and being positioned alongside said sliding rods for said first print wheels for adjusting said supplementary print wheels.

13. Device according to claim 12 wherein said angular orientation motor defines various orientation positions of said interface means for adjusting various print wheels and for mounting or demounting the removable print head.

* * * * *